US006931683B1

(12) United States Patent
Elkin et al.

(10) Patent No.: US 6,931,683 B1
(45) Date of Patent: Aug. 23, 2005

(54) ADVANCED INFANT REFLUX WEDGE FOR INFANT

(76) Inventors: Robynne R. Elkin, 4032 Bonita Dr., Plano, TX (US) 75024; Craig Troop, 4701 Augusta Dr., Frisco, TX (US) 75034-6839

( * ) Notice: Subject to any disclaimer, the term of this patent is extended or adjusted under 35 U.S.C. 154(b) by 0 days.

(21) Appl. No.: 10/798,704

(22) Filed: Mar. 10, 2004

(51) Int. Cl.[7] ..... A47C 20/00
(52) U.S. Cl. ..... 5/655; 5/632; 5/633; 5/655.9
(58) Field of Search ..... 5/632, 633.6, 55, 5/655.9

(56) References Cited

U.S. PATENT DOCUMENTS 3,555,582 A * 1/1971 Radford ..... 5/632
3,648,308 A * 3/1972 Greenawalt ..... 5/632
4,171,549 A * 10/1979 Morrell et al. ..... 5/632
5,012,539 A * 5/1991 Grigg ..... 5/644
5,432,967 A * 7/1995 Raftery ..... 5/633
5,440,770 A * 8/1995 Nichols ..... 5/655
5,700,059 A * 12/1997 Moscot ..... 297/452.17
5,800,368 A * 9/1998 Klingemann et al. ..... 602/1
6,292,964 B1 * 9/2001 Rose et al. ..... 5/630

* cited by examiner

*Primary Examiner*—Michael Trettel
(74) *Attorney, Agent, or Firm*—Michael L. Diaz

(57) ABSTRACT

A reflux wedge for supporting an infant suffering from acid reflux is disclosed. The reflux wedge includes a wedge-shaped main body having a top side and a bottom side. In addition the reflux wedge includes a torso support section providing a substantially flat incline of approximately 25 to 45 degrees to receive and support the torso of the infant in a prone position. The torso support section is located on the top side of the wedge-shaped main body. The reflux wedge also includes a head support section adjoining the torso support section for receiving and supporting the head of the infant. An arch runs down a longitudinally aligned midline on the top side for receiving and supporting the infant and encouraging protraction of the shoulders. A crater is optionally located on the bottom side for receiving an infant in a supine position.

20 Claims, 3 Drawing Sheets

ADVANCED INFANT REFLUX WEDGE FOR INFANT

BACKGROUND OF THE INVENTION

1. Technical Field of the Invention

This invention relates to support devices, and more particularly, to a device for supporting and elevating a recumbent infant.

2. Description of Related Art

Gastroesophageal Reflux Disease, also know as GERD, is a common ailment which involves a back flow of acid from the stomach into the esophagus. This acid can irritate or even damage the delicate lining on the inside of the esophagus. The usual symptom is heartburn, which is an uncomfortable burning sensation behind the breastbone. In some individuals this reflux is frequent enough to cause more significant problems, resulting in GERD. Thus, GERD is a clinical condition that occurs when reflux of stomach acid into the esophagus is severe enough to impact the patient's life and/or damage the esophagus. Infants are susceptible to GERD and suffer tremendously from its effects.

Standard protocol for alleviating the symptoms of GERD for infants is to elevate a recumbent infant approximately 30 to 45 degrees. A wedge-shaped mattress is commonly used to rest an infant upon. The infant is positioned at an inclined angle to reduce the reflux action common with GERD. The infant is held in place by a sling or harness device. The elevated positioning of the infant is very helpful. Typically, the infant is laid face down in a prone position for more effective results. For infants not afflicted with GERD, it is not recommended to lay an infant on their stomachs. It has been found that laying infants on their stomachs results in a higher incidence of infant deaths. In any event, laying an infant on either his back or stomach results in some very significant musculoskeletal problems associated with prolonged use of the elevated mattress. In particular, the shoulders of the infant tend to retract the shoulder muscles backwards. However, because of the prolonged use of the elevated mattress, the infant is not able to protract (move forward) his shoulders. The lack of an ability for the infant to protract his shoulders is detrimental to the musculoskeletal development of the infant. A device is needed which enables the infant to enjoy the benefits of the inclined positioning on a wedge apparatus without positioning the infant in such a manner as to encourage protraction of the shoulders.

Thus, it would be a distinct advantage to have an apparatus to alleviate the symptoms of GERD while encouraging the protraction of the infant's shoulders. This apparatus would provide for good positioning and allow proper musculoskeletal development. It is an object of the present invention to provide such an apparatus.

SUMMARY OF THE INVENTION

In one aspect, the present invention is a reflux wedge for supporting an infant. The wedge includes a wedge-shaped main body having a top side and a bottom side. The wedge includes a torso support section providing a substantially flat incline to receive and support the torso of the infant lying in a prone position. The torso support section is located on the top side of the wedge-shaped main body. Additionally, the wedge includes a head support section adjoining the torso support section for receiving and supporting the head of the prone infant. The head support section is curvilinear and substantially horizontal and located on the top side of the wedge-shaped main body. An arch runs down a longitudinally aligned midline on the top side for receiving and supporting the prone infant and encouraging protraction of the shoulders.

In another aspect, the present invention is a reflux wedge for supporting an infant. The wedge includes a wedge-shaped main body having a top side and a bottom side. On a top side is located a torso support section providing a substantially flat incline to receive and support the torso of the infant lying prone and a head support section adjoining the torso support section for receiving and supporting the head of the prone infant, the head support section being curvilinear and substantially horizontal. An arch runs down a longitudinally aligned midline on the top side for receiving and supporting the prone infant and encouraging protraction of the shoulders. On the opposite or bottom side is located a shallow concave hollow or crater. When the wedge is flipped over, thus positioning the bottom side on top, an infant may be positioned in a supine position within the crater. When positioned in the crater, the shoulders of the infant are encouraged to protract upward. While having the bottom side facing upward, the head support region provides a pivot region allowing the wedge-shaped main body to rock, providing vestibular input to the infant.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
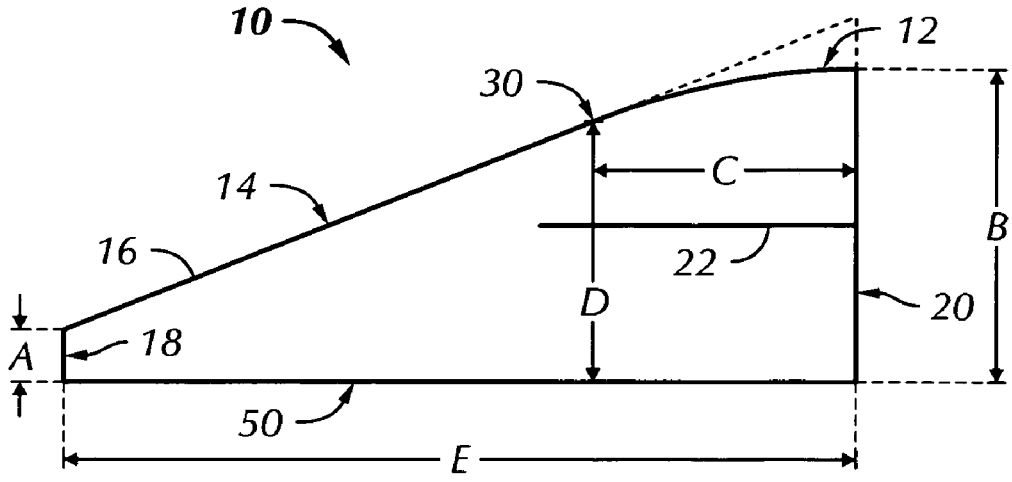
FIG. 1, a side view of an infant reflux wedge in the preferred embodiment of the present invention.

Preferred embodiments of the invention are now described below with reference to various examples of how the invention can best be made and used. Like reference numerals are used throughout the description and several views of the drawings to indicate like or corresponding parts.

Referring now to FIG. 1, a side view of an infant reflux wedge 10 is illustrated. The reflux wedge 10 includes a head support region 12 and a torso support region 14 located on a top side 16. In the preferred embodiment, the reflux wedge is dimensioned with a bottom end section 18 having a height A of between one and two inches. On an opposite head end section 20, the head reaches a height B of approximately 12 inches. Approximately halfway down the height B is optionally provided a horizontal cut 22 running the width of the wedge. Preferably, the horizontal cut has a length or depth of approximately 12 inches.

The head support region 12 is curvilinear-shaped starting at distance C of approximately 10 inches from the head end section 20. The head support region, at an intersection point 30 is approximately a height D of approximately 10 inches above a horizontal surface on which the reflux wedge lies. FIG. 1 depicts a dashed line to illustrate that the head support region curves to a relatively horizontal orientation rather than continuing the angular inclination of the top side of the torso support region. The head of an infant is positioned in a prone (stomach/abdomen down) position upon the head support region.

The torso support region 14 is sized and shaped to provided an incline between approximately 15 and 45 degrees. The torso and legs of the infant (prone position) are positioned on the torso support region.

The reflux wedge 10 preferably comprises a structural plastic foam such as a foam polyurethane material, urethane foam, or other elastomeric material. The foam used may consist of a variety of colors and may comprise a variety of different densities that determine the hardness or softness of the wedge 10. The foam may also possess anti-static properties and may be latex free.

More specifically, Indentation Force Deflection (IFD) measures the firmness of a piece of foam. The test involves placing a 4"×15"×15" piece of foam on a flat surface. A round metal piece, 8" in diameter, pushes down on the piece of foam. The amount of pounds of pressure required to squeeze the piece of foam from 4" to 3" is the IFD. Preferably, the reflux wedge 10 of the present invention has an IFD of between about 22 and 42.

Additionally, the State of California Bureau of Home Furnishings Technical Bulletin #117 (bulletin #117) requires that all foam sold in retail in the state of California must pass a fire retardant test. The test involves exposing a piece of foam to an open flame until the foam is burning. Once the foam is burning, the foam is removed from the flame. Fire retardant foam ceases to burn once removed from the flame. Preferably, since California is such a large market, the wedge 10 meets bulletin # 117. Likewise, it is desirable that the foam type meets or exceeds the requirements of FAA (Federal Aviation Administration) 25.853(a) App. F Part I(a)(1)(ii). This section refers to a 12 second vertical hang burn test.

It should be apparent to one skilled in the art that the reflux wedge 10 may comprise a variety of elastomeric materials. For example, a white J32 foam type having a density of 0.90–0.95 and an IFD of 29.0–36.0 may be employed. Alternatively, a blue L32XB foam type having a density of 1.20–1.26 and an IFD of 32.0–37.0 that exceeds California Bulletin #117 flammability requirements may be employed. Alternatively, a pink P25T foam type having a density of 1.20–1.26 and an IFD of 24.0–29.0 may be employed.

The reflux wedge is preferably constructed of the above-referenced foam. The foam allows a soft surface for an infant to lie upon. In the preferred embodiment, the foam is dense enough to support the weight of the infant at an inclined angle. However, in an alternate embodiment of the present invention, a core frame may be constructed of a rigid material and foam applied to the outside surface of the core frame.

The infant reflux wedge 10 may be constructed in a variety of different ways. Preferably, the structural plastic foam is manufactured from a low pressure injection mold process. However, the molding can be manufactured by any conventional polymer fabrication method. For example, the fabrication method may involve compression molding using heat and pressure to force the molten polymer or resin, introduced between the mating surfaces of a moveable mold, into the shape of the mold. In another embodiment, the fabrication method can be comprised of injection molding where a molten polymer is compressed into a closed mold cavity. Other fabrication method s include reaction injection molding and extrusion filament spinning.

Preferably, the reflux wedge 10 is constructed as an integral piece of moldable material. However, it should be apparent to one skilled in the art that the reflux wedge 10 may be constructed of several pieces that are assembled into one piece by any known or unknown method. For example, the pieces may be affixed to one another by an adhesive such as an epoxy or glue.

Figure 2:
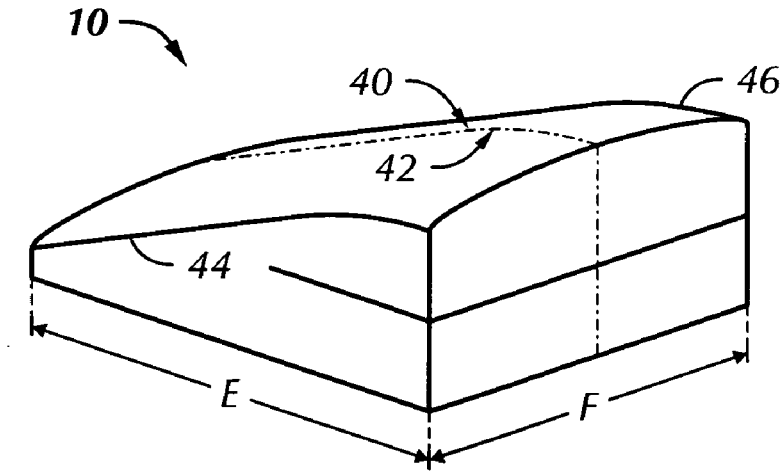
FIG. 2 is a top perspective view of the infant reflux wedge 10 of FIG. 1.

FIG. 2 is a top perspective view of the infant reflux wedge 10 of FIG. 1. The reflux wedge is constructed with an arch 40 running down a midline 42 of the wedge. The arch slopes downward from the midline to sides 44 and 46. Preferably, the arch slopes downward from the midline to each side of the wedge by a height of approximately one to two inches. The arch may run the full length of the width or approximately ¾ of the length of the wedge. In addition, the arch may or may not be located on the head support region.

The length E of the wedge is preferably between 26 and 30 inches. The width F of the wedge is preferably about 24 inches. The dimensions are preferred. It should be understood that the wedge may be decreased or increased in size and still provide the same function. In addition, the angle of the wedge is preferably configured to incline the torso of the infant between 30 and 40 degrees, however the incline may range from 15 degrees to 45 degrees.

Figure 3:
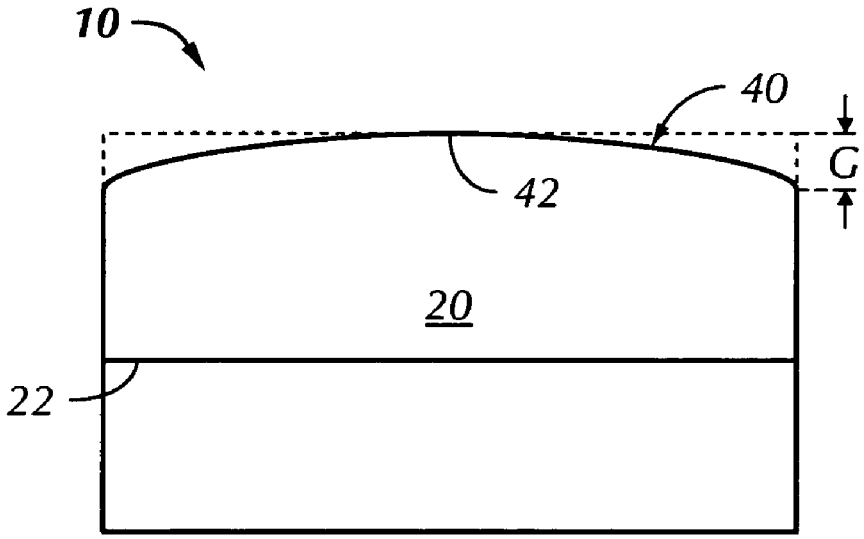
FIG. 3 is a view form the head end section 20 of FIG. 1 in the preferred embodiment of the present invention.

FIG. 3 is a view form the head end section 20 of FIG. 1. FIG. 3 illustrates the arch 40 located at the midline 42. The arch slopes down from the midline to the sides 42 and 44 a distance G, which is approximately between one and three inches.

Figure 4:
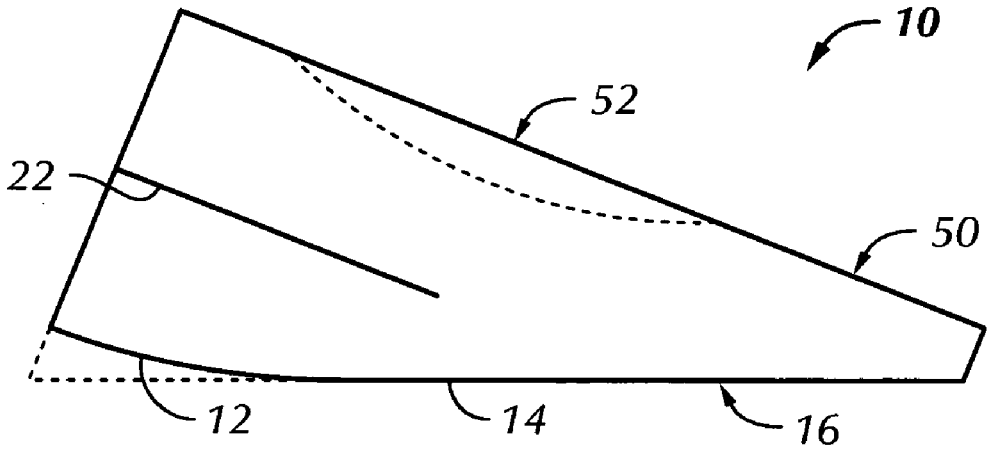
FIG. 4 is a side view of the infant reflux wedge flipped over with a bottom side 50 facing upward.

FIG. 4 is a side view of the infant reflux wedge flipped over with a bottom side 50 facing upward. The infant reflux wedge may optionally include a shallow concave crater section 52 upon the bottom side of the wedge. When the infant reflux wedge is flipped over and the bottom side is facing upward, the crater section 52 is exposed.

Figure 5:
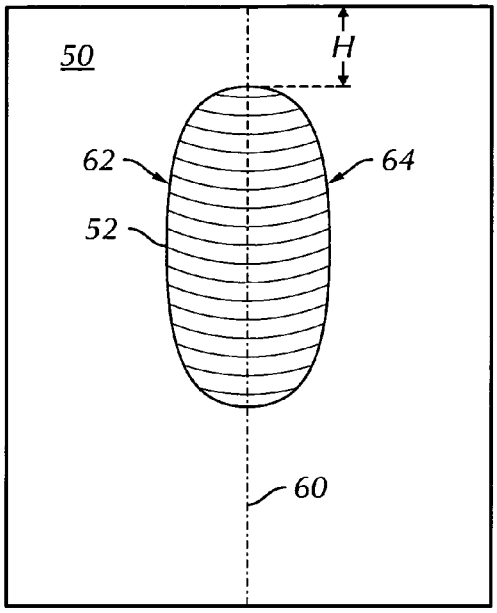
FIG. 5 is a top view of the bottom side of the infant reflux wedge.

FIG. 5 is a top view of the bottom side of the infant reflux wedge 10. The crater section is a hollowed out area preferably having the shape of an oval and having a gradual sloping from a midline 60 to its outer sides 62 and 64. The deepest portion of the crafter is at the midline 60 where the depth is approximately one to three inches. The crater is preferably positioned a distance H of approximately four inches from the head end section 20. The crater also preferably has a length of approximately 16 inches and a width of 8 inches. However, the size and placement of the crater may vary. With the bottom side facing upward (FIG. 5), the infant is positioned in a supine position (face up) within the crater section 52.

With reference to FIGS. 1–5, the operation of the infant reflux wedge 10 will now be explained. To alleviate symptoms from GERD, infants are inclined at an angle between 30 and 45 degrees. The infant may be positioned in a prone (stomach/abdomen down) position on the top side 16. The infant is positioned so that the infant's head lies to either side on the head support region 12. The remaining portion of the infant (torso and legs) is positioned on the torso support region 14. The infant is positioned so that the infant essentially straddles the arch, thereby allowing or encouraging the shoulders of the infant to lie in a forward or protracted position. In addition, since the head support region is curvilinear, the infant may comfortably lay his head upon the head support region. Utilization of such a wedge usually requires a harness or sling to ensure the infant does not slide down the wedge. The harness or sling may be affixed to the wedge by straps or cords running within the horizontal cut 22.

Although it is recommended that an infant suffering from GERD be positioned in a prone position, parents may wish to position the infant on his back. If it is desired to lay the infant on his back (supine position), the infant reflux wedge may be flipped over to a position where the bottom side 50 is facing upward (FIGS. 4 and 5). The infant is positioned in the crater section 52, allowing the infant to "nest" within the crater section. In such a position, the infant's shoulders are lifted upward into a protracted position which promotes slight flexion of the upper and lower extremities. The crater will also provide the infant with a boundary for comfort and containment. In addition, with the head support region contacting the horizontal surface on which the wedge is placed, a rocking motion of the wedge may be initiated (similar to a rocking chair). Also, a harness or sling may be utilized by wrapping cords or straps through the horizontal cut 22.

Utilization of either side of the infant reflux wedge encourages protraction of the infant's shoulders, slight flexion of the upper and lower extremities and discourages retraction of the shoulders. With the infant reflux wedge, the infant can comfortably utilize an inclined surface to alleviate symptoms associated with GERD while simultaneously reducing or eliminating the problems associated with prolonged use of an inclined surface and the infant's muscular development. The present invention allows the infant to be positioned on either his back or his stomach. In addition, the infant reflux wedge allows the infant to rest his head comfortable upon the curvilinear-shaped head support region.

Figure 6:
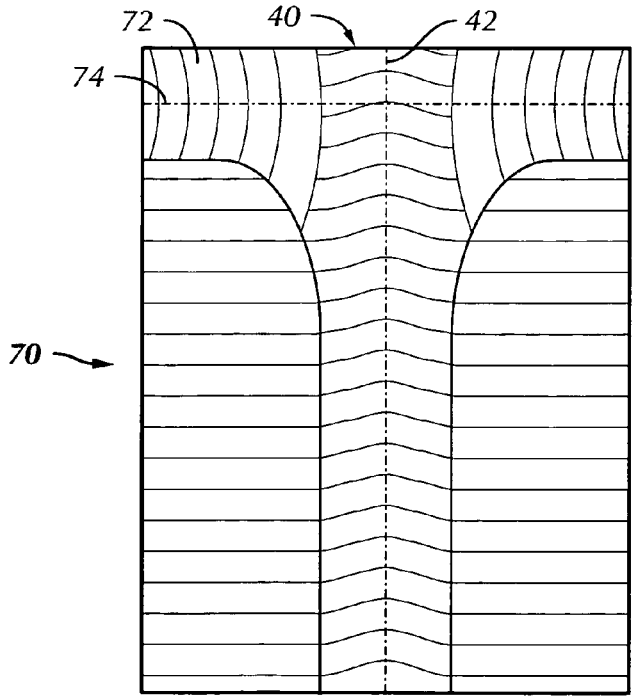
FIG. 6 is a top view of a top side 70 of the infant reflux wedge 10 in an alternate embodiment of the present invention.

FIG. 6 is a top view of a top side 70 of the infant reflux wedge 10 in an alternate embodiment of the present invention. The top side 70 may still include the arch 40 running down the midline 42. In addition, the top side includes a ridge portion 72 running across the width F of the wedge. The ridge portion is sloped downward from a transverse line 74. The ridge portion and the arch form a "T" shape.

In reference to FIG. 6, the infant may be positioned in the prone position straddling the arch 40. The shoulders of the infant are allowed to protract forward. The infant's head is positioned upon the ridge portion 72.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A reflux wedge for supporting an infant, said wedge comprising:

a wedge-shaped main body having a top side and a bottom side;

a torso support section providing a substantially flat incline to receive and support the torso of the infant lying in a prone position, the torso support section located on the top side of the wedge-shaped main body;

a head support section adjoining the torso support section for receiving and supporting the head of the prone infant, the head support section being curvilinear and substantially horizontal and located on the top side of the wedge-shaped main body; and an arch running down a longitudinally aligned midline on the top side for receiving and supporting the prone infant and encouraging protraction of the shoulders.

2. The reflux wedge for supporting an infant of claim 1 further comprising:

a shallow concave crater positioned on the bottom side of the wedge-shaped main body; and the bottom side being flipped to an upward position to support the infant in a supine position and encourage protraction of the shoulders of the infant.

3. The reflux wedge for supporting an infant of claim 2 wherein the crater is sloped to a depth of between approximately one and three inches.

4. The reflux wedge for supporting an infant of claim 2 wherein the crater is positioned along a second midline running longitudinally down the bottom side of the wedge-shaped main body.

5. The reflux wedge for supporting an infant of claim 2 wherein the head support region provides a pivot region allowing the wedge-shaped main body to rock when the bottom side is positioned upward.

6. The reflux wedge for supporting an infant of claim 1 further comprising a horizontal cut positioned on a portion of the wedge-shaped main body for receiving straps of a retaining apparatus for retaining the infant on the wedge-shaped main body.

7. The reflux wedge for supporting an infant of claim 1 wherein the top side and the bottom side are constructed of a foam material.

8. The reflux wedge for supporting an infant of claim 7 wherein the foam material is fire retardant.

9. The reflux wedge for supporting an infant of claim 1 wherein the incline is between 5 and 40 degrees.

10. The reflux wedge for supporting an infant of claim 1 wherein the arch runs the entire length of the top surface.

11. The reflux wedge for supporting an infant of claim 1 wherein the arch runs approximately ¾ of the length of the top surface.

12. The reflux wedge for supporting an infant of claim 1 wherein the arch slopes down from the midline to each side of the top side between approximately one and three inches.

13. A reflux wedge for supporting an infant, said wedge comprising:

a wedge-shaped main body having a top side and a bottom side;

a torso support section providing a substantially flat incline to receive and support the torso of the infant lying prone, the torso support section located on the top side of the wedge-shaped main body;

a head support section adjoining the torso support section for receiving and supporting the head of the prone infant, the head support section being curvilinear and substantially horizontal and located on the top side of the wedge-shaped main body;

an arch running down a longitudinally aligned midline on the top side for receiving and supporting the prone infant and encouraging protraction of the shoulders;

a shallow concave crater positioned on the bottom side of the wedge-shaped main body;

the bottom side being flipped to an upward position to support the infant in a supine position and encouraging protraction of the infant's shoulders; and wherein the head support region provides a pivot region allowing the wedge-shaped main body to rock when the bottom side is positioned upward.

14. The reflux wedge for supporting an infant of claim 13 wherein the crater is sloped to a depth of between approximately one and three inches.

15. The reflux wedge for supporting an infant of claim 13 wherein the crater is positioned along a second midline running longitudinally down the bottom side of the wedge-shaped main body.

16. The reflux wedge for supporting an infant of claim 13 further comprising a horizontal cut positioned on a portion of the wedge-shaped main body for receiving retaining straps of a device for retaining the infant on the wedge-shaped main body.

17. The reflux wedge for supporting an infant of claim 13 wherein the top side and the bottom side are constructed of a foam material.

18. The reflux wedge for supporting an infant of claim 17 wherein the foam material is fire retardant.

19. The reflux wedge for supporting an infant of claim 13 wherein the incline is between 15 and 45 degrees.

20. The reflux wedge for supporting an infant of claim 13 wherein the arch runs the entire length of the top surface.

* * * * *